US005390462A

United States Patent [19]

Kreiter

[11] Patent Number: 5,390,462

[45] Date of Patent: Feb. 21, 1995

[54] REMOVABLE SURFACE COVERINGS

[75] Inventor: Donald E. Kreiter, Wyckoff, N.J.

[73] Assignee: Pam International Company, Inc., Saddle Brook, N.J.

[21] Appl. No.: 549,522

[22] Filed: Jul. 6, 1990

[51] Int. Cl.[6] ..... A47F 5/08

[52] U.S. Cl. ..... 52/506.05; 52/506.08; 52/506.01; 211/87; 211/189

[58] Field of Search ..... 211/87, 94, 189; 52/36, 52/239, 473, 507, 506.01, 506.05, 506.08

[56] References Cited

U.S. PATENT DOCUMENTS

| | | | |
|---|---|---|---|
| 4,579,308 | 4/1986 | Jensen . | |
| 4,607,753 | 8/1986 | Radek | 52/36 |
| 4,615,448 | 10/1986 | Johnstonbaugh . | |
| 4,629,076 | 12/1986 | Amstutz et al. . | |
| 4,694,965 | 9/1987 | Parnell . | |
| 4,964,618 | 10/1990 | Kennedy et al. . | |

FOREIGN PATENT DOCUMENTS

| | | | |
|---|---|---|---|
| 1480732 | 6/1973 | United Kingdom | 52/36 |
| 1574827 | 9/1980 | United Kingdom . | |

*Primary Examiner*—Carl D. Friedman
*Assistant Examiner*—Wynn E. Wood
*Attorney, Agent, or Firm*—Dickie, McCamey & Chilcote; Leland P. Schermer

[57] ABSTRACT

Removable surface coverings used in slat-wall designed walls and fixtures, and tools for their utilization, are disclosed and claimed herein. Removable cover strips are disclosed, which snap onto and off of slat-wall generally. A removable groove insert is disclosed, which snaps into and out of a groove of a slat-wall. The removable surface coverings allow a multitude of changes in appearance in slat-wall designed walls and fixtures to occur quickly, easily, cheaply and with great decorative variety. At the same time, display hardware can be used in conjunction with the removable surface coverings of the present invention. Cover removal tools are provided for assistance in removing cover strips after installation. An insert removal tool is provided for assistance in removing groove inserts after installation. A cover and insert installation tool is provided for assisting in installing the cover strips and groove inserts. A single tool assembly for assistance in installing and removing cover strips and groove inserts is provided.

20 Claims, 9 Drawing Sheets

REMOVABLE SURFACE COVERINGS

BACKGROUND OF THE INVENTION

1. Field of the Invention

This invention relates to the field of interior design, as well as the field of merchandise display. More specifically, this invention relates to products and methods that permit one to vary the appearance of commonly used wall and display fixture constructions without expending substantial effort and expense, and without permanently altering the wall or display fixture each time a change in appearance is desired.

2. Background Art

Many establishments construct interior walls in a way that creates a certain desired "look" or "theme." A very commonly used wall construction is known as "slat-wall," which comprises alternating wider flat panel portions (slats) and narrower channels (grooves). Retailers of consumer goods are a good example of the type of establishment that uses slat-wall. Slat-wall type construction has also been used on free-standing or wall-attachable display fixtures. In particular, many franchises employ slat-wall as a way to create a consistent look or theme in their stores.

The use of slat-walls in various types of establishments is useful for additional reasons beside creating a desire look or theme. The combination of slats and grooves permits the establishments to attach a wide variety of removable hardware to the wall or the display fixtures. A common type of hardware used in these applications is display hardware. There are many different types of display hardware which serve many different purposes. Most display hardware attaches to slat-wall by having a projection that fits within the groove and a surface that is supported to some extent by being in contact with the slat. The display hardware can be used to support many items, including but not limited to merchandise, signs, lighting, shelving and the like.

In the past, establishments that utilize slat-wall as part of their interior design have had limited versatility in the appearances they could create. Since slat-wall is literally a way to construct the walls of an establishment or a display fixture, changes to the "look" or "theme" of these items previously required substantial effort, and in most instances resulted in a permanent alteration of the slat-wall. For example, slat-wall has been painted in the past to change its colors, if it is made of a paintable grade. Slat-wall has also been covered with adhesive tape as a way to change its appearance. In addition, slat-wall that is laminated typically cannot be painted to change its color, appearance and/or texture, resulting in removal and replacement with new colored slat-wall when an enhancement or remodeling is desired. Attempts to provide coverings that slide onto the slat and/or into the groove have proven unsatisfactory since slat-wall designs, once constructed, often have no room or access along their sides to place coverings for sliding attachment or disengagement. These and other aspects of slat-wall have limited the options available to those who use slat-wall the most—commercial establishments that sell consumer goods. The ability to quickly, easily, cheaply and frequently change or remodel the look or theme of commercial establishments is important in many businesses, especially those that deal in seasonal goods, clothing and other trendy merchandise.

SUMMARY OF THE INVENTION

It is an object of the present invention to provide removable surface coverings for altering the visual appearance of walls or fixtures utilizing the slat-wall design. It is another object of the present invention to provide individualized removable cover strips and removable groove inserts so that their number and placement is left to the design discretion of the establishment or its interior designer.

It is a further object of the present invention to provide removable cover strips and removable groove inserts that are easy to manufacture, are relatively inexpensive, are of variable color, design, texture and/or appearance, and are easy to use. It is also an object of the present invention to provide products that can be snapped onto or into the slat-wall and snapped off of or out of the slat-wall, relatively quickly and easily. Another object of the present invention is to provide removable surface coverings that, once installed, still permit the use of display hardware on the slat-wall designed wall or fixture.

It is yet another object of the present invention to provide individual tools and a tool assembly that facilitate the attachment and removal of the cover strips and/or groove inserts from the slat-wall quickly, easily, cheaply and/or frequently. Because of the ease with which the interchangeable surface coverings of the present invention can be made, attached and removed, scores of design variations in the appearance of portions of walls and fixtures, or entire walls and fixtures, are possible with little interruption to the ordinary business activities of the establishment and with little relative expense and effort.

The present invention comprises removable cover strips, removable groove inserts and tools for attaching and removing the removable cover strips and removable groove inserts. The removable cover strips can be snapped onto and off of the slat-wall panels. The removable groove inserts can be snapped into and out of the grooves of the slat-wall. Attachment and removal of the cover strips and/or groove inserts can be achieved in the present invention by "front" loading and removal, where the person changing the cover strip or groove insert can stand directly facing the slat or groove when attaching or removing the cover strip or groove insert and apply forces generally opposite to the plane of the slat-wall design (as opposed to "end" or "side" loading and removal, i.e., sliding the cover strips or groove inserts along the plane of the slat-wall design). Attachment and removal of the cover strips and groove inserts are facilitated in this manner, and are further facilitated by use of a tool. The removable groove inserts can be snapped into and out of the grooves with the aid of a different tool than that used for the removable cover strips. A tool that is used for the removable cover strips can also be combined with a tool that is used for the removable groove inserts, into a single tool assembly.

The above-referenced and other objects, features, and advantages of the present invention are more fully understood by reference to the accompanying drawings and detailed description.

DETAILED DESCRIPTION OF THE PREFERRED EMBODIMENTS

Figure 1:
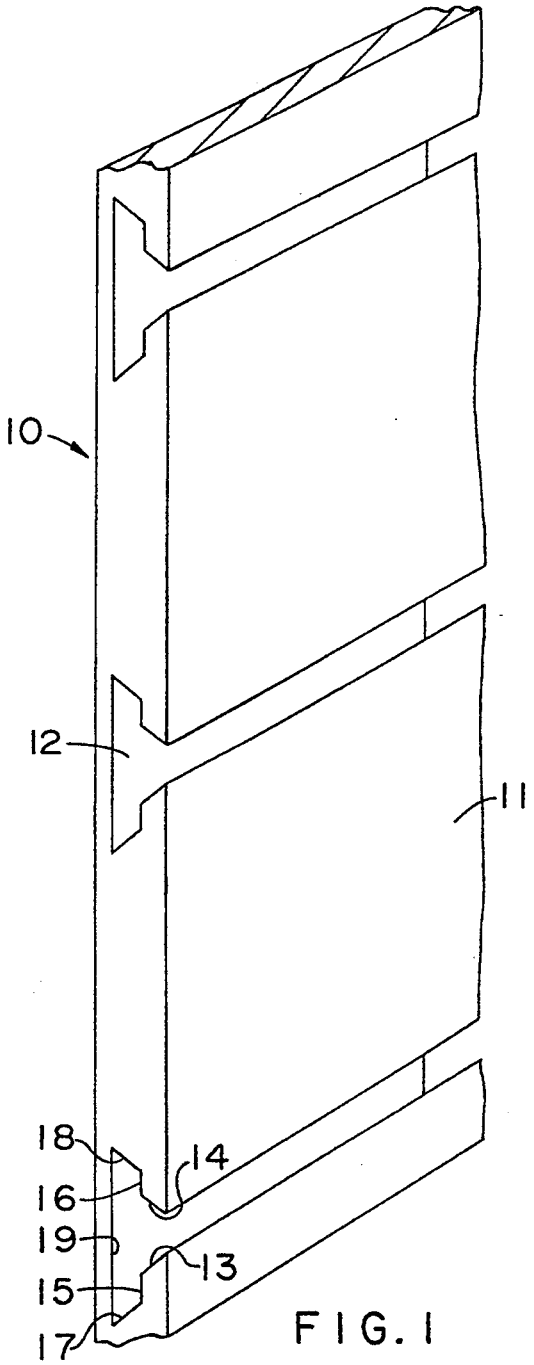
FIG. 1 is a perspective view of a typical slat-wall design used in the interior of commercial establishments.

FIG. 1 shows a typical slat-wall design construction that is used to form a wall in commercial establishments. The slat-wall 10 comprises two primary components, a wider flat panel portion (or slat) 11 and a narrower channel portion (or groove) 12.

The wider flat panel portion or slat 11 generally comprises the surface of the wall, while the narrower channel portion or groove 12 comprises a recess into which various types of removable display hardware can be partly inserted, for overall attachment to the slat-wall 10.

The narrower channel portion or groove 12 can comprise a first side 13, an opposite second side 14, a third side 15 adjacent to said first side 13, a fourth side 16 adjacent to said second side 14, a fifth side 17 adjacent to said third side 15, a sixth side 18 adjacent to said fourth side 16, and a seventh side 19 adjacent to said fifth side 17 and said sixth side 18. The sides of groove 12 can be angled at 90 degrees, or at angles more and/or less than 90 degrees as in FIG. 1. In addition, the groove can comprise a greater or lesser number of sides than are shown in FIG. 1, as well as shapes other than linear sides.

Figure 2B:
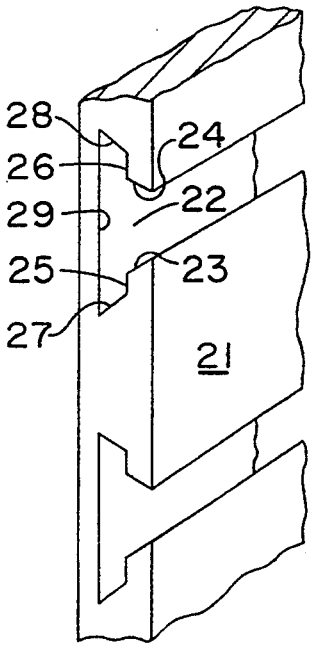
FIG. 2B is a side view of slats and grooves in a free-standing display fixture.
Figure 2A:
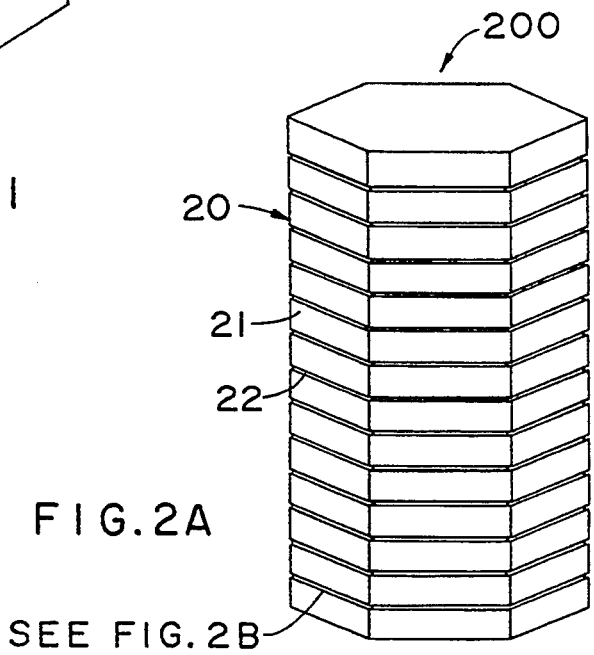
FIG. 2A is a perspective view of a free-standing display fixture having a slat-wall design.

FIG. 2A shows a typical slat-wall design construction 20 that is made part of a free-standing display fixture 200. Just as in the slat-wall design used to form part of a wall, the slat-wall design 20 that is part of a free-standing display fixture 200 comprises a slat 21 and a groove 22, where said groove 22 generally comprises a recess into which various types of removable display hardware can be partly inserted, for overall attachment to the slat-wall design display fixture 200. As shown in FIG. 2B, the groove 22 of the slat-wall design display fixture 200, like the groove 12 of the slat-wall design, can comprise a first side 23, an opposite second side 24, a third side 25 adjacent to said first side 23, a fourth side 26 adjacent to said second side 24, a fifth side 27 adjacent to said third side 25, a sixth side 28 adjacent to said fourth side 26 and a seventh side 29 adjacent to said fifth side 27 and said sixth side 28. Again, the shape of the groove 22 can vary from that shown in FIG. 2B.

Figure 3A:
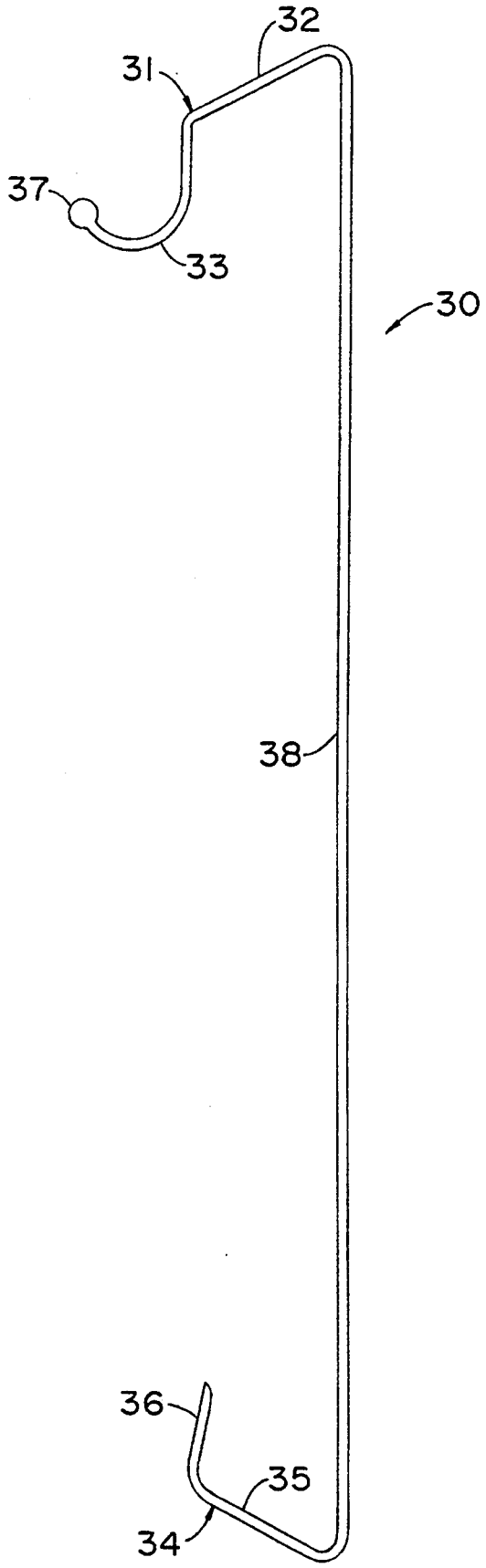
FIG. 3A is a side view of one type of removable cover strip.

FIG. 3A is a side view of a removable cover strip (or cover) 30. The cover strip 30 comprises a first means for securing a removable cover strip 31, which first securing means can comprise a first intermediate flat angled portion 32 and an extreme curved portion 33. Many different components and shapes can comprise the first securing means 31, so long as they permit the cover strip 30 to be snapped onto the slat 11 (as in FIG. 1), to be secured thereon and to be removed therefrom without permanently damaging the cover strip 30. The extreme curved portion 33 can comprise a beaded edge 37. The extreme curved portion 33 and beaded edge 37 are useful in permitting the cover strip 30 to be snapped onto the slat 11, to be secured thereon and to be removed therefrom, as explained in this specification.

The cover strip (or cover) 30 further comprises a second means for securing a removable cover strip 34, which second securing means can comprise a second intermediate flat angled portion 35 and an extreme flat angled portion 36. The second securing means 34 can comprise many different components and shapes, so long as they permit the cover strip 30 to be snapped onto slat 11 (as in FIG. 1), to be secured thereon and to be removed therefrom without permanently damaging the cover strip 30.

The first securing means 31 is connected to the second securing means 34 by a panel portion 38. The panel portion 38 of the removable cover strip 30 covers the panel portion or slat 11 of the slat-wall 10 when used on an interior wall constructed of a slat-wall design (as in FIG. 1), or it covers the slat 21 of the slat-wall design display fixture 200 (as in FIG. 2).

Figure 3B:
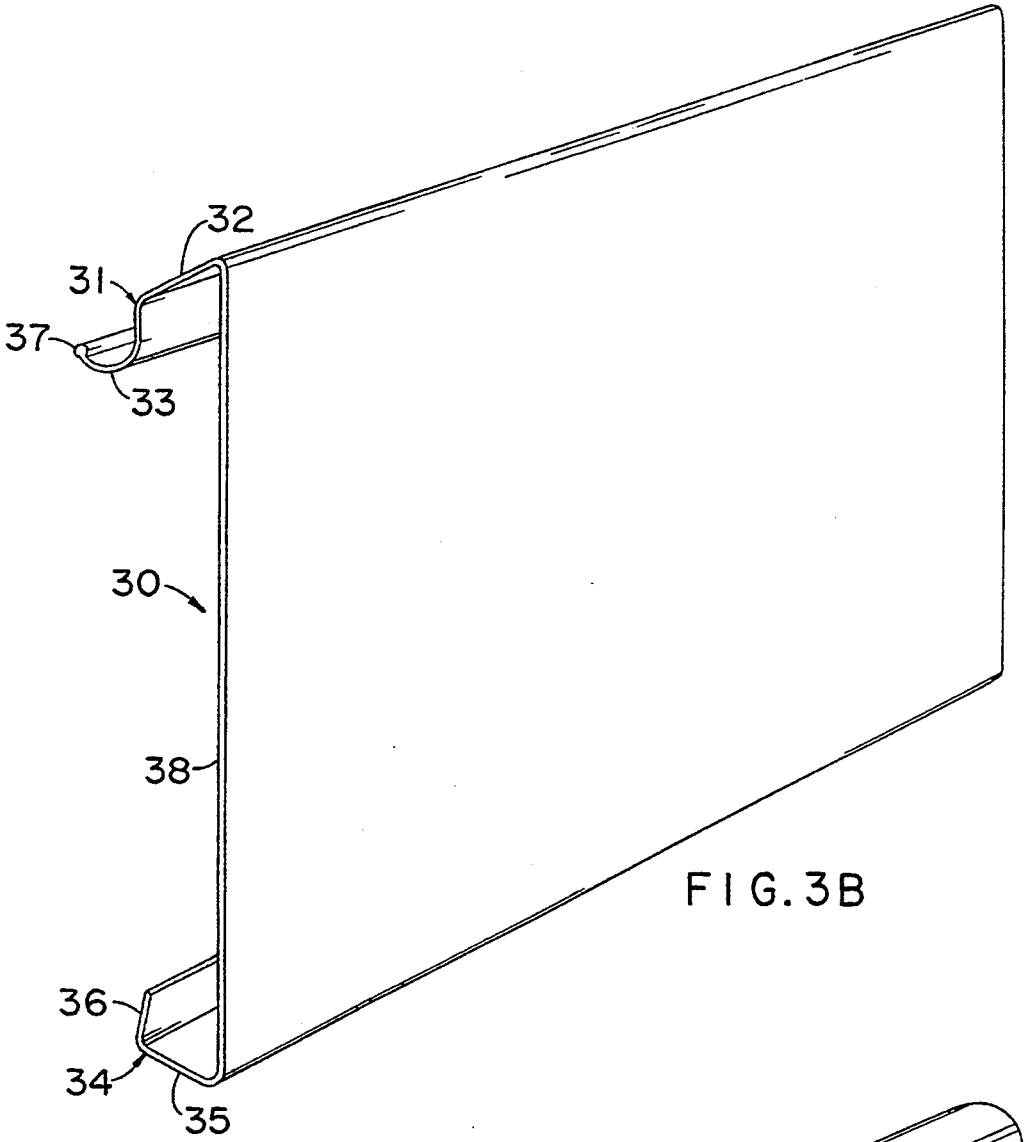
FIG. 3B is a perspective view of the removable cover strip of FIG. 3A.

FIG. 3B shows a perspective view of a removable cover strip 30. The removable cover strip 30 can be manufactured by well-known extrusion techniques to varying lengths and heights, and to fit varying sizes and shapes of slats and grooves that comprise the slat-wall design.

Figure 4A:
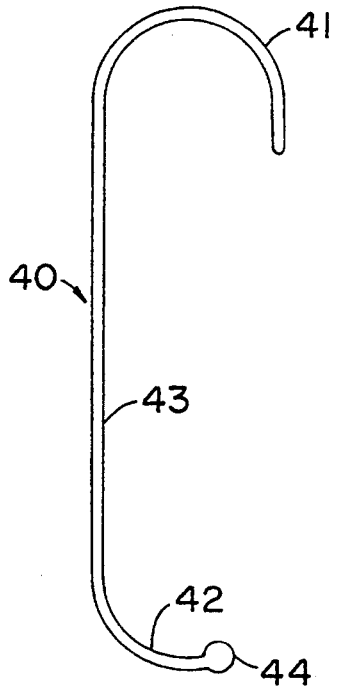
FIG. 4A is a side view of one type of removable groove insert.

FIG. 4A shows a side view of a removable groove insert (or insert) 40. The removable groove insert (or insert) 40 comprises a first curved end 41 for insertion into a groove, and a second curved end 42 for insertion into a groove, wherein said second curved end 42 can be supported by the first securing means 31 of the cover strip 30 located generally below insert 40 on panel 11. As shown in FIG. 4A, the first curved end 41 is curved for about 180 degrees, and the second curved end 42 is curved for about 120 degrees. However, the specific shape of the first end 41 and second end 42 can vary, so long as they permit insertion and withdrawal of insert 40. The second curved end 42 can comprise a beaded edge 44, which assists in securing and removing insert 40 as explained in this specification.

The first curved end 41 is connected to the second curved end 42 by a panel portion 43. The removable groove insert 40 is inserted into and removable from the groove 12 of the slat-wall 10 when used on an interior wall constructed of a slat-wall design (as in FIG. 1), or it is inserted into and removable from the groove 22 of the slat-wall design display fixture 200 (as in FIG. 2).

Figure 4B:
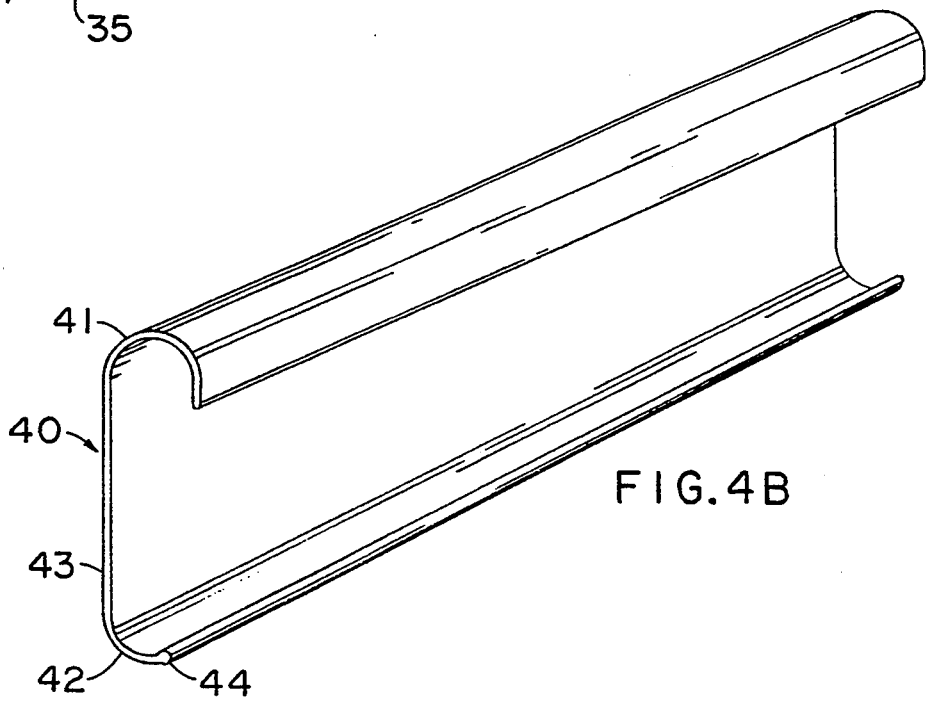
FIG. 4B is a perspective view of the removable groove insert of FIG. 4A.

FIG. 4B is a perspective view of a removable groove insert 40. The removable groove insert 40 can be manufactured by well-known extrusion techniques to varying lengths and heights, and to fit varying sizes and shapes of slats and grooves that comprise the slat-wall design.

Figure 5:
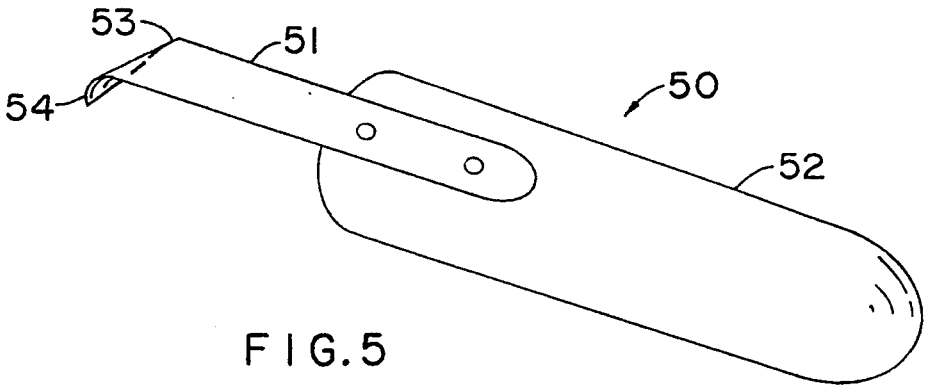
FIG. 5 is a perspective view of a cover removal tool.

FIG. 5 is a perspective view of a cover removal tool 50. The cover removal tool 50 comprises a curved end hook 51 attached to a handle 52. The curved end hook 51 can be made of a thin flat spring steel strip, one end of which is attached to handle 52 and the other end of which is a straight edge 53 for an initial portion along the right side of the edge of curved end hook 51, which straight portion starts to curve down and under along the remaining portion 54 of the edge of the curved end hook 51.

Figure 6:
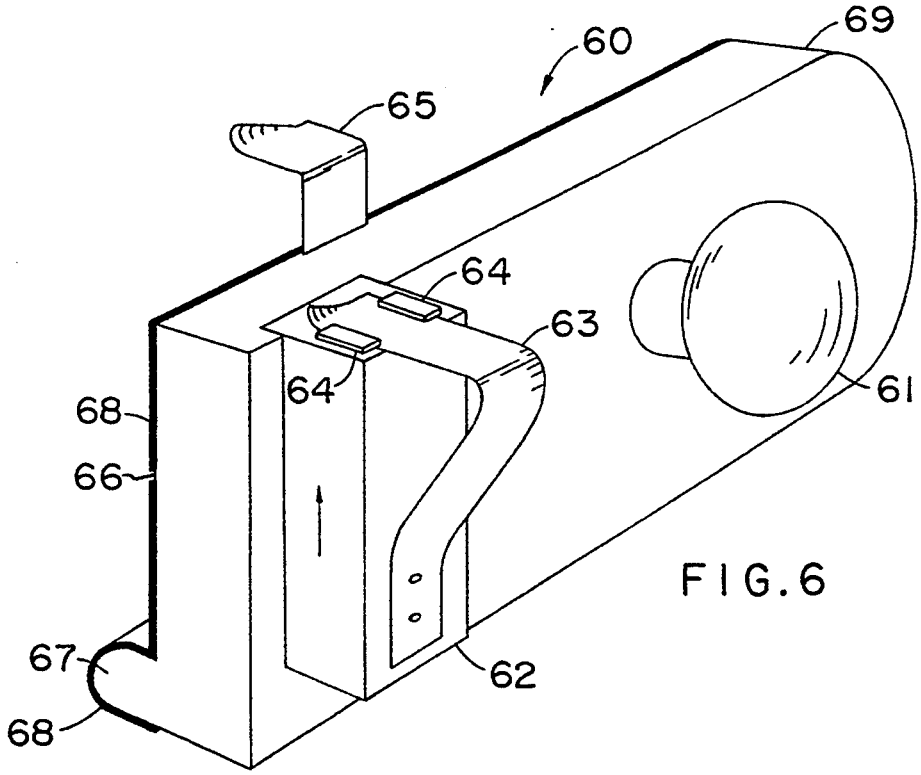
FIG. 6 is a perspective view of an insert removal tool.

FIG. 6 is a perspective view of a groove insert attachment and removal tool 60. The insert attachment and removal tool 60 comprises a handle 61 attached to a generally rectangular body 69, and a sliding removal tool holder 62 attached to said generally rectangular body 69. An insert removing tool 63 is attached to said sliding removal tool holder 62, and can itself slide at one end while being constrained between two control guides 64. Said insert attachment and removal tool 60 further comprises an insert raising tool 65, attached to a generally flat side 66 of said tool 60, which generally flat side 66 can be covered with felt 68. The generally flat side 66 is adjacent to a rounded projecting guide edge 67, which can also be covered by felt 68.

Figure 7:
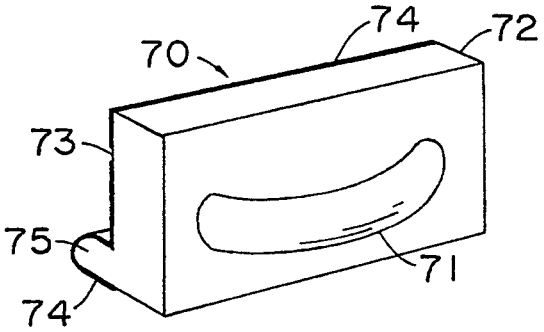
FIG. 7 is a perspective view of a cover and insert installation tool.

FIG. 7 is a perspective view of a cover and insert installation tool 70. The cover and insert installation tool 70 comprises a handle 71 attached to a generally rectangular body 72 having a generally flat side 73 covered with felt 74. Adjacent to generally flat side 73 is a rounded projecting guide edge 75, which can also be covered with felt 74. The rounded projecting guide edge 75 pushes the inserts 40 into the grooves 12, and it acts to lift the second securing means 34 of the cover strips 30, which facilitates the attachment of cover strips 30, as does generally flat side 73.

Figure 8:
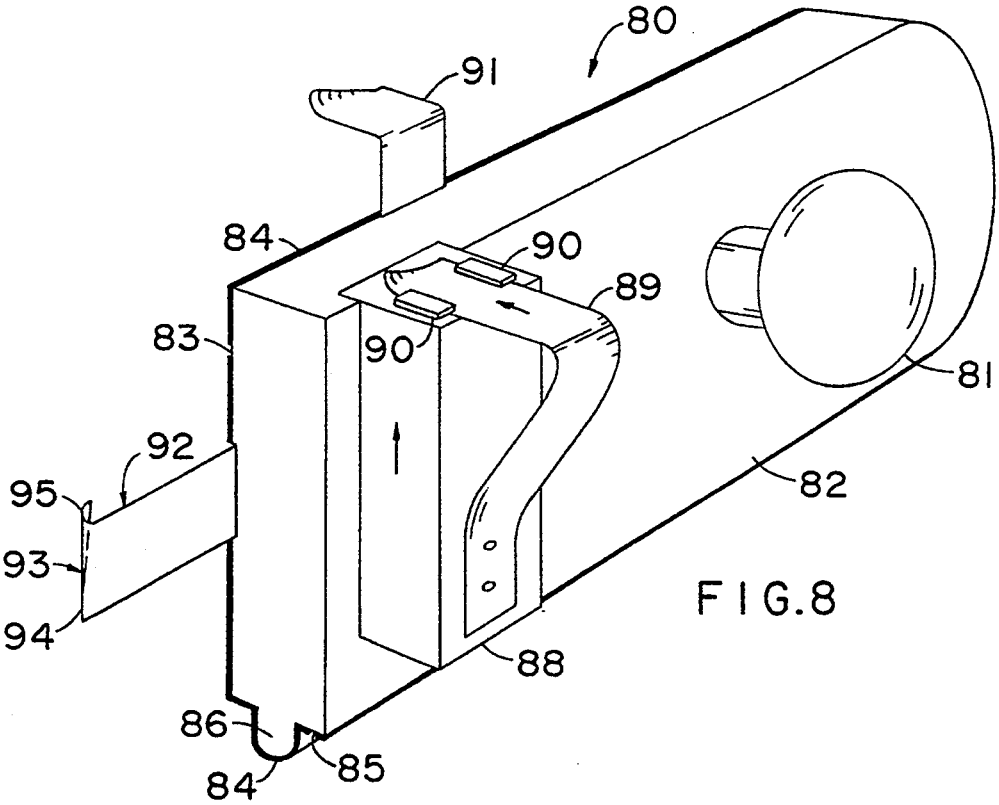
FIG. 8 is a tool assembly for installing and removing covers and inserts.

FIG. 8 is a tool assembly 80 for installing and removing covers and inserts. The tool assembly 80 comprises a handle 81 attached to a generally rectangular body 82 having a generally flat side 83 covered with felt 84. On an adjacent side 85 to said generally flat side 83 of said body 82, a rounded projecting guide edge 86 is provided, which can also be covered with felt 84. The tool assembly 80 further comprises a sliding removal tool holder 88 slidably attached to said generally rectangular body 82. An insert removing tool 89 is attached to said sliding removal tool holder 88, and can itself slide at one end while being constrained between two control guides 90. Said tool assembly 80 further comprises an insert raising tool 91, attached to said generally flat side 83. Said tool assembly 80 further comprises a cover removal tool 92, wherein said cover removal tool comprises a curved end hook 93. The cover removal tool 92 can be made of a thin flat spring steel strip, one end of which is attached to generally flat side 83. The curved hook is a straight edge 94 for an initial portion along the left side of the edge of the curved end hook 93, which straight portion starts to curve down and under along the remaining hook portion 95 of the edge of curved end hook 93.

The covers and inserts of this invention are removable, in the sense that they each can be snapped onto and into, respectively, slat-wall designed structures, and thereafter they can be snapped off of or out of the slat-wall, and removed therefrom, without causing permanent damage to the covers or inserts.

One way of attaching and removing the inserts and covers can be explained with particular reference to FIGS. 1, 3B, 4B and 9–13. A cover 30, as shown in FIG. 3B, is placed with its panel 38 parallel and adjacent to slat 11 (as in FIG. 1) or slat 21 (as in FIG. 2). With reference to FIG. 1, the second securing means 34 of cover 30 is placed in a first groove 12 by rotating, a few inches from the slat-wall, the first securing means 31 of the cover 30 toward the person installing it, with the arcuate rotation occurring about an imaginary axis parallel to the plane of the slat-wall and along the intersection of the edges of panel 38 and the second intermediate flat angled portion 35. Thereafter, while holding cover 30 in this general angular position, the second securing means 34 is placed into groove 12 and hooked onto the portion of groove 12 that comprises sides 14 and 16.

Once the second securing means 34 is inserted in this angle and manner, the first securing means 31 is snapped into another groove 12, the one above the groove 12 into which the second securing means 34 was initially placed. The first securing means 31 can be pushed into groove 12 along said extreme curved portion 33, to snap into place in groove 12. The extreme curved portion 33, in part because of its curvature, slides along side 13 of groove 12 until it clears the intersection of the edges of sides 13 and 15. This pushing can be accomplished by placing the generally flat side 66 of insert attachment and removal tool 60, shown in FIG. 6, along panel 38. With the felt 68 used to cover the generally flat side 66, the tool 60 can be slid along panel 38 until the cover 30 snaps into place. The generally flat side 73, covered with felt 74, of cover and insert installation tool 70, shown in FIG. 7, can be used for this same purpose. The generally flat side 83 of tool assembly 80, shown in FIG. 8, is also covered with felt 84 and can be used for this same purpose.

The cover 30 and groove insert 40 are to be made of a flexible material that permits attachment and removal without breaking or permanently deforming the cover or insert. Many common materials can serve this function. Extruded plastic cover strips and groove inserts are particularly appropriate for this invention. Polyvinylchloride and other polymer materials serve the functions of the present invention. In addition, wood and laminated materials can be used for the cover strips and groove inserts. By using extrusion techniques and dies, which are well-known in the field, the covers and inserts can be manufactured to have various profiles and lengths that will be consistent with the invention disclosed and claimed herein.

After one or more covers 30 have been placed over a slat 11 or 21 as described above, an insert 40, as shown in FIG. 4B, can be inserted into groove 12 in the following manner. The first curved end 41 is pointed toward the approximate intersection of sides 16 and 18, as shown in FIG. 1, and pushed into the intersection until in contact therewith. Thereafter, the second curved end 42 is pushed along side 13 until it snaps over the edge and comes to rest somewhere between sides 15, 17 and 19. The insertion of insert 40 in this manner is facilitated in part by the curvature of second curved end 42. The insertion of insert 40 can be accomplished by using the rounded projecting guide edge 67 adjacent the generally flat side 66 of insert attachment and removal tool 60. The rounded projecting guide edge 67 is covered with felt 68, and is placed along the panel portion 43 of insert 40, as shown in FIG. 4B, and pushed into the groove and slid along its length or in several locations until it has fully snapped in. This pushing and sliding of insert 40 into the groove 12 can also be accomplished by utilization of the rounded projecting guide 75, covered with felt 74, of cover and installation tool 70, shown in FIG. 7. Likewise, rounded projecting guide edge 86 of tool assembly 80, shown in FIG. 8, is also covered with felt 84 and can be used for this same purpose. Once installed in groove 12, insert 40 can be resting on cover 30 if there is a cover below the groove into which insert 40 has been placed. It is generally desirable to place two vertically adjacent covers on consecutive panels of the slat-wall before installing the intervening insert.

This or similar methods of installation continue until the tastes of the interior designer or the establishment are satisfied. It is clearly not necessary, though, to the successful utilization of my invention to always cover every slat or every groove, or to always use a cover adjacent to an insert, or to always install covers and inserts in this precise manner. In addition, covers can be made to provide a surface covering in the grooves, without the use of a separate groove insert. Decorative considerations permit the user of my invention to select any combination of covers and inserts for use on slat-wall, constructed as walls, as part of display fixtures or in any other application. A plurality of covers and inserts, or covers alone, or inserts alone, can be referred to as a slat-wall covering system, it being understood that the number and location of covers and inserts is a matter of discretion.

Figure 9:
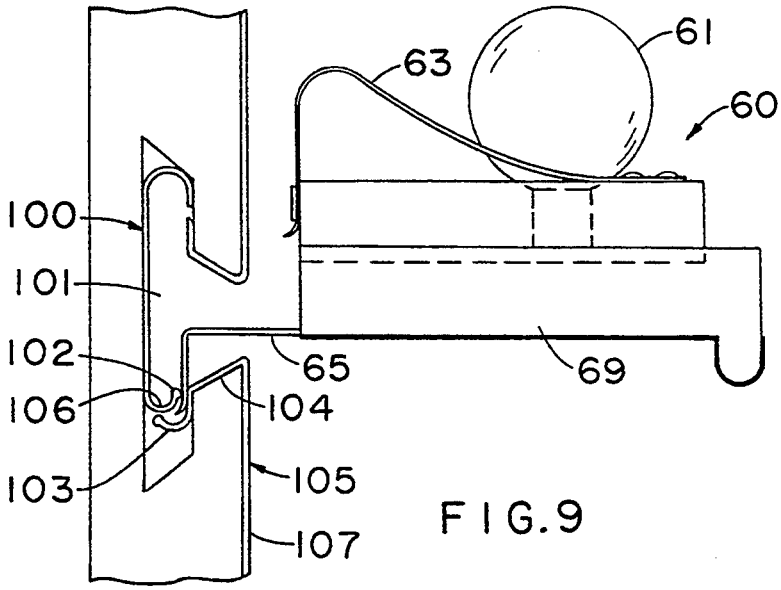
FIG. 9 is a side view of the first step in a method for removing an insert.

FIG. 9 is a side view showing the first step for one method of removing an insert. The removal of insert 100 from groove 101 can be accomplished with the aid of a groove insert removal tool 60, as shown in FIG. 6. The method for removing an insert will be described with reference to the groove insert removal tool of FIG. 6, although it certainly is possible to also utilize other tools such as the tool assembly of FIG. 8.

The first step in removing insert 100 is to place the insert raising tool 65 of the groove insert removal tool 60 shown in FIG. 6 under the beaded edge 102 and the second curved end 106 of insert 100 and over the first securing means 104 of the cover strip 105 located immediately below insert 100, in particular the extreme curved portion 103. Of course, if there is no cover strip 105 immediately below insert 100, then the insert raising tool 65 will be placed only below the beaded edge 102 and second curved end 106 of insert 100. Once the edge of insert raising tool 65 has been placed between the insert 100 and the immediately lower cover strip 105 (when a strip is used immediately below insert 100), the entire groove insert removal tool 60 is rotated downward to raise the second curved end 106 of the insert 100.

Figure 10:
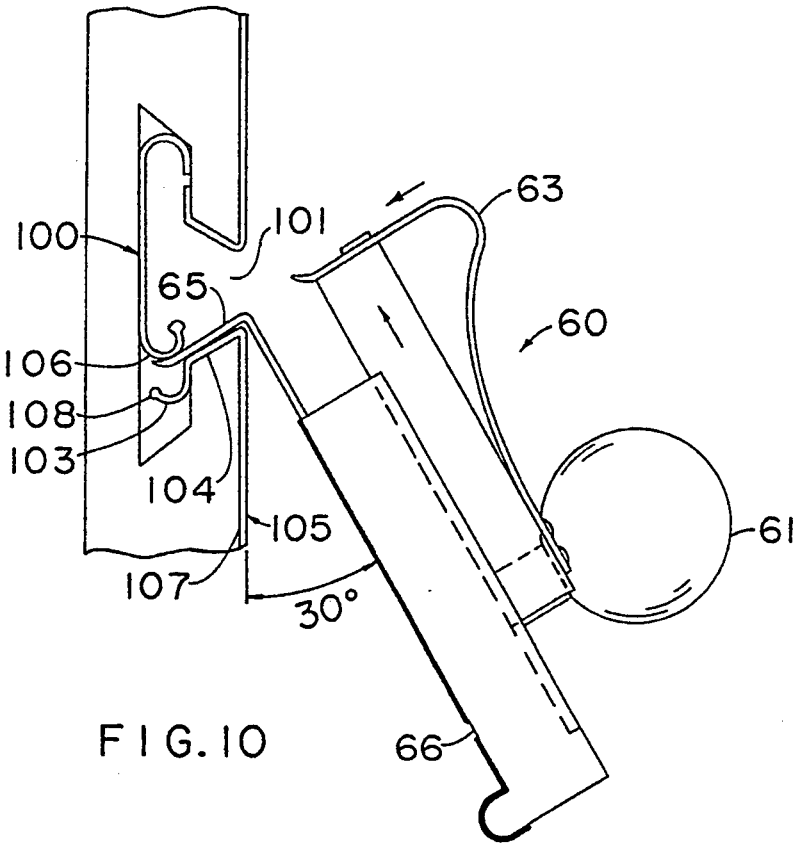
FIG. 10 is a side view of an intermediate step in a method for removing an insert.

As shown in FIG. 10, the next step in this method for removing insert 100 is to continue rotating the groove insert removal tool 60, and therefore also rotating insert raising tool 65, until the generally flat side 66 is at about a 30 degree angle from the panel portion 107 of cover strip 105 located below insert 100. This rotation can cause insert 100 to be raised above its resting position. At this point, the edge of insert removing tool 63 is pushed in until it rests above the first securing means 104 of the cover strip 105 located below insert 100, and below the second curved end 106 of insert 100.

Once the curved edge of the insert removing tool 63 has hooked under the second curved end 106 of insert 100, the next step is to position groove insert removal tool 60 essentially flat along panel portion 107 of cover strip 105, and to slide the groove insert removal tool 60 laterally, along the length of the insert 100. Once the groove insert removal tool 60 has been slid along the length of the insert 100, the second curved end 106 is released from its inserted position and the insert 100 is capable of being extracted from groove 101 by hand.

Figure 11:
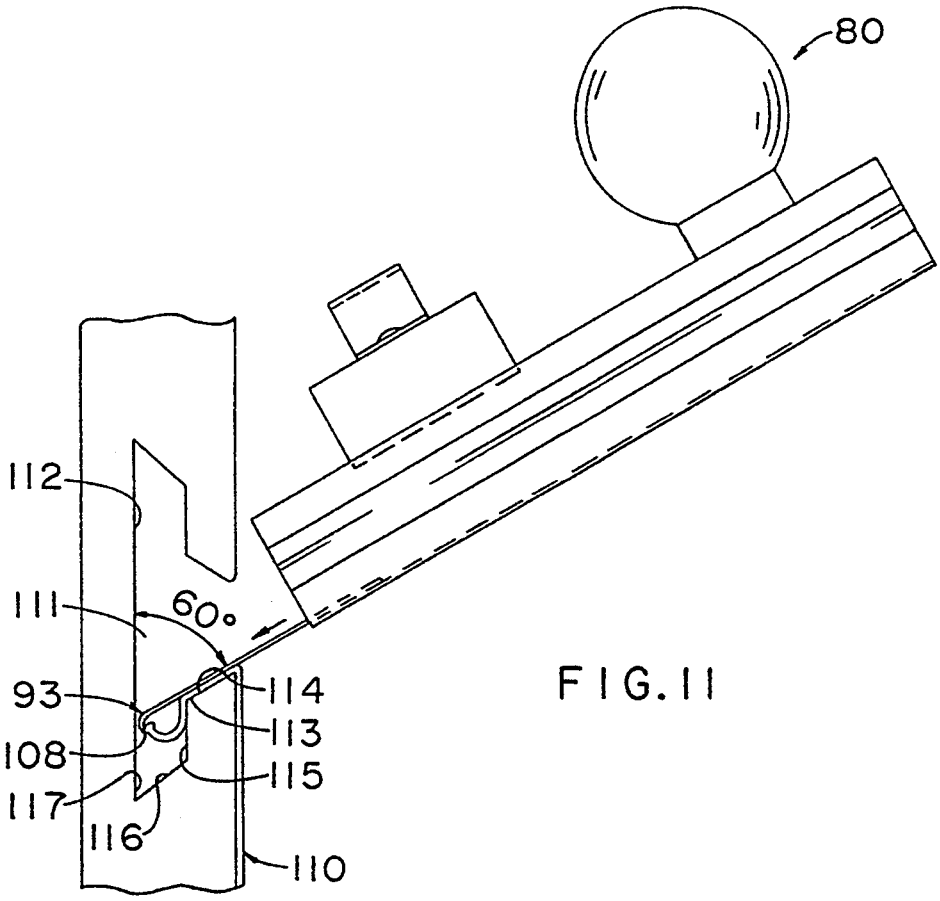
FIG. 11 is a side view of the first step in a method for removing one type of cover.
Figure 12:
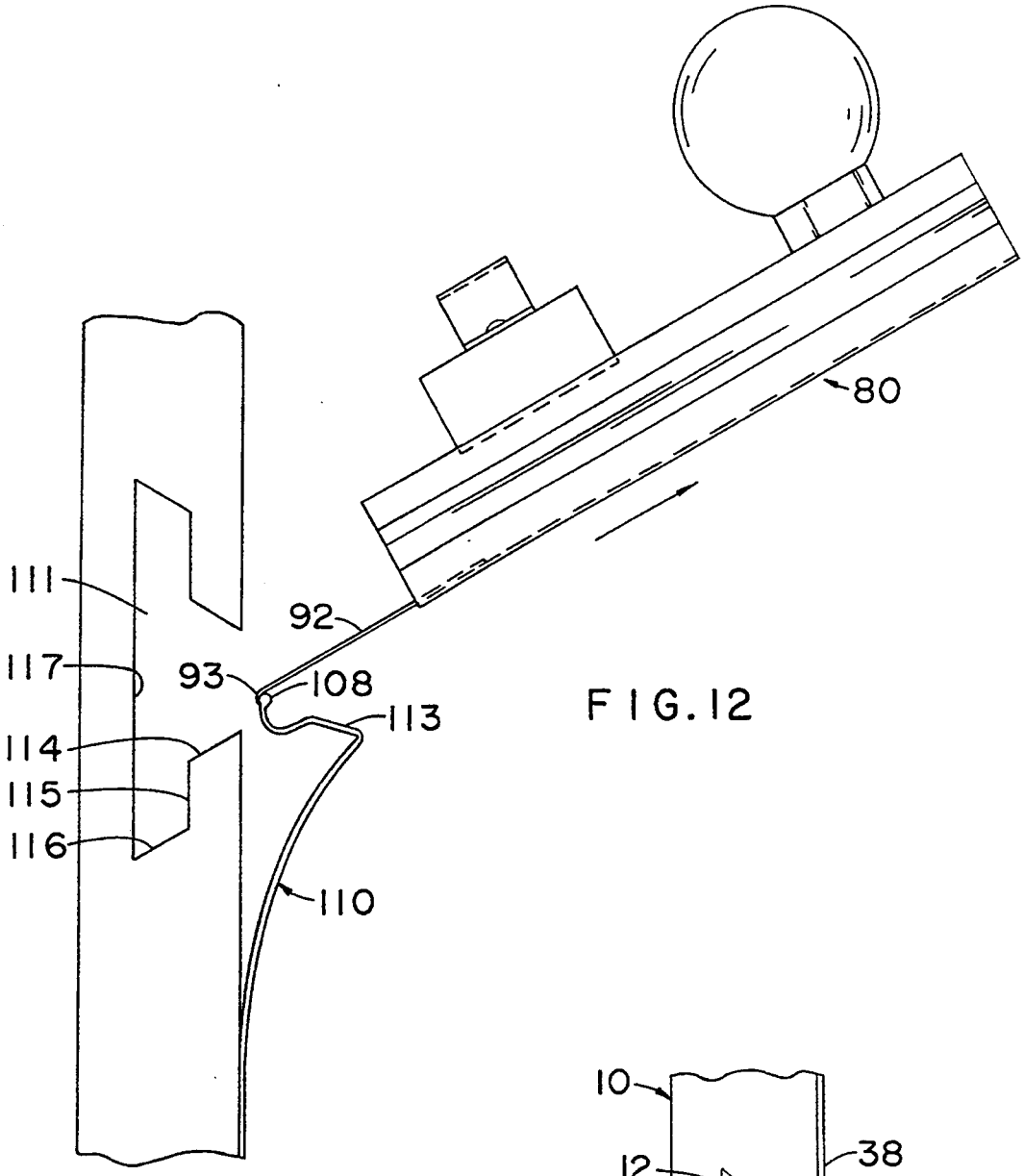
FIG. 12 is a side view of an intermediate step in a method for removing one type of cover.
Figure 13:
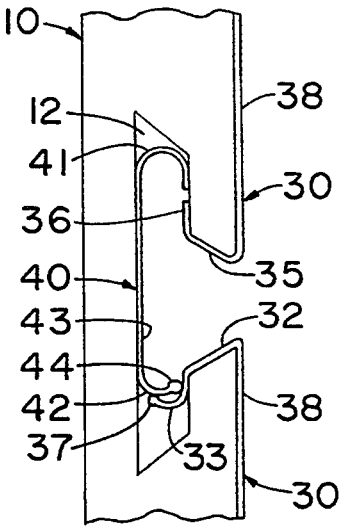
FIG. 13 is a side view of a slat-wall design that has alternating removable cover strips and a removable groove insert on consecutive slats and in a groove, respectively.

One method for removing cover strip 110 can be seen in FIGS. 11 and 12. The first step in this method for removing cover strip 110 is to place either the curved end hook 51 of cover removal tool 50 shown in FIG. 5, or the curved end hook 93 of the cover removal tool 92 shown as part of tool assembly 80 in FIG. 8, into groove 111 at an angle of about 60 degrees from side 112 of groove 111. The curved-end hook 93 of tool assembly 80 in FIG. 8 comprises two portions, a straight edge 94 for an initial portion along the left side of the hook 93, and a curved remaining portion 95 which increases in curvature along the edge and toward the right side of the hook 93. The straight edge 94 should be placed between side 112 and beaded edge 108 of first securing means 113, by angling the handle 81 of cover removal tool assembly 80. Thereafter, the handle 81 of cover removal tool assembly 80 should be rotated so as to guide curved remaining portion 95 of hook 93 behind and around beaded edge 108 of first securing means 113. Once the curved remaining portion 95 of hook 93 has been pushed over the beaded edge 108 of cover strip 110, the hook can grab the beaded edge for pulling the first securing means 113 of the cover strip 110 out of groove 111. As mentioned earlier, the cover strip 110 is to be made of a flexible material, such as a plastic, so that it can bend back for removal.

The next step in removing cover strip 110 is to pull tool assembly 80, as shown in FIG. 8 (or cover removal tool 50 of FIG. 5), up, out and down from groove 111, so that first securing means 113 is raised off of and out of, respectively, groove 111's side 114 and its sides 115, 116 and 117. Once first securing means 113 has been freed from its attachment as described herein, the first securing means 113 can be rotated away from the slat-wall to release the entire cover strip 110.

Figure 14A:
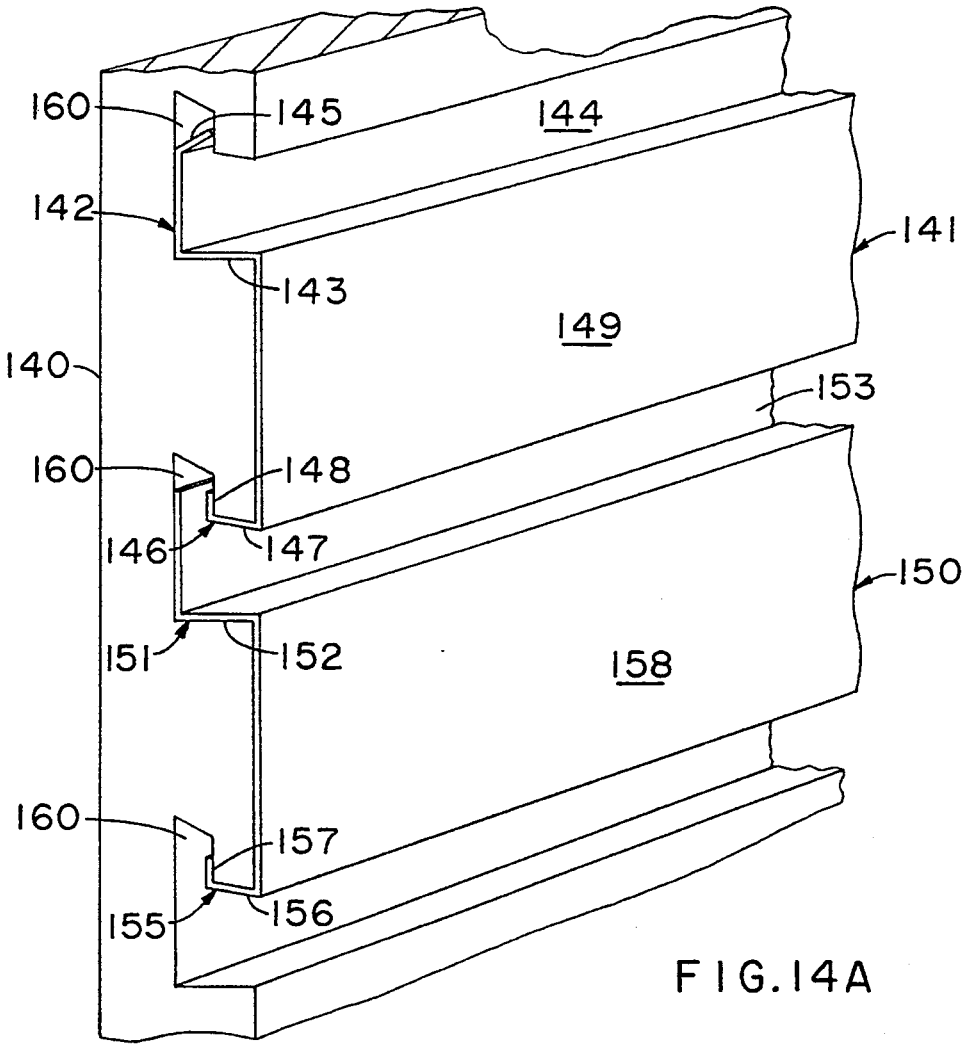
FIG. 14A is a perspective view of an alternative slat-wall design used in the interior of commercial establishments, having a first alternative removable cover strip attached thereto and a second alternative removable cover strip, different from the first alternative, below the first alternative cover strip.
Figure 14B:
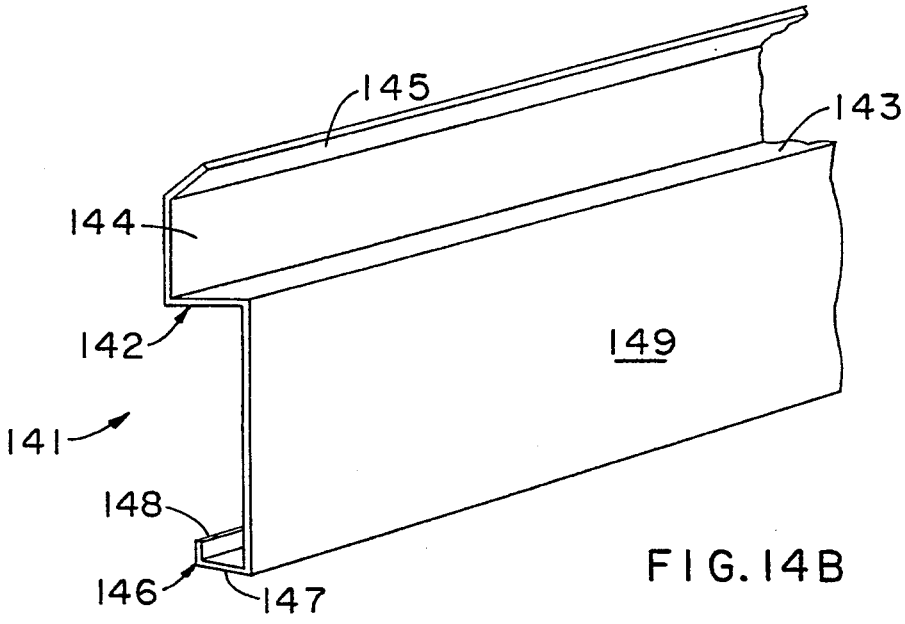
FIG. 14B is a perspective view of the first alternative removable cover strip shown in FIG. 14A.

FIG. 14A shows a perspective view of an alternative slat-wall design 140, which is commercially available today. Shown as attached to alternative slat-wall 140 are two alternative removable cover strips 141 and 150. Alternative removable cover strip 141 can comprise a first alternative means for securing a removable cover strip 142. This first alternative securing means 142 can comprise a first side 143, a second side 144 connected at about a 90 degree angle to said first side 143 (an intermediate flat angled portion), and a third side 145 connected at about a 135 degree angle to said second side 144 (an extreme flat angled portion). Third side 145 assists in preventing first alternative securing means 142 from coming out of groove 160, by being in contact with an internal portion of groove 160 or of a portion of display hardware that may be placed in groove 160 and forcing second side 144 back in groove 160.

Alternative removable cover strip 141 can comprise a second alternative means for securing a removable cover strip 146, which can comprise a first side 147 and a second side 148 connected to said first side 147 at an angle approximately equal to the angle of the corresponding sides of groove 160 upon which second alternative securing means 146 is secured.

Alternative removable cover strip 141 further comprises a panel 149, which connects first alternative securing means 142 to second alternative securing means 146, and which covers the slat of this slat-wall design.

Alternative removable cover strip 141 works slightly differently than, for example, cover 30 shown in FIG. 3B. For example, alternative removable cover strip 141 has a first alternative securing means 142 that is of sufficient height along side 144 to provide a surface covering for groove 160, without the need for a separate groove insert as shown, for example, in FIGS. 4B and 13.

Alternative removable cover strip 141 is attached similarly as cover 30 shown in FIG. 3B, and as described herein with respect thereto. Initially, second alternative securing means 146 can be hooked onto an upper portion of a first groove 160. Thereafter, first alternative securing means 142 is rotated or placed in a second groove 160 above the initial groove 160. First alternative securing means 142 is then snapped into place along the lower portion of groove 160 located above the initial groove 160.

Figure 15:
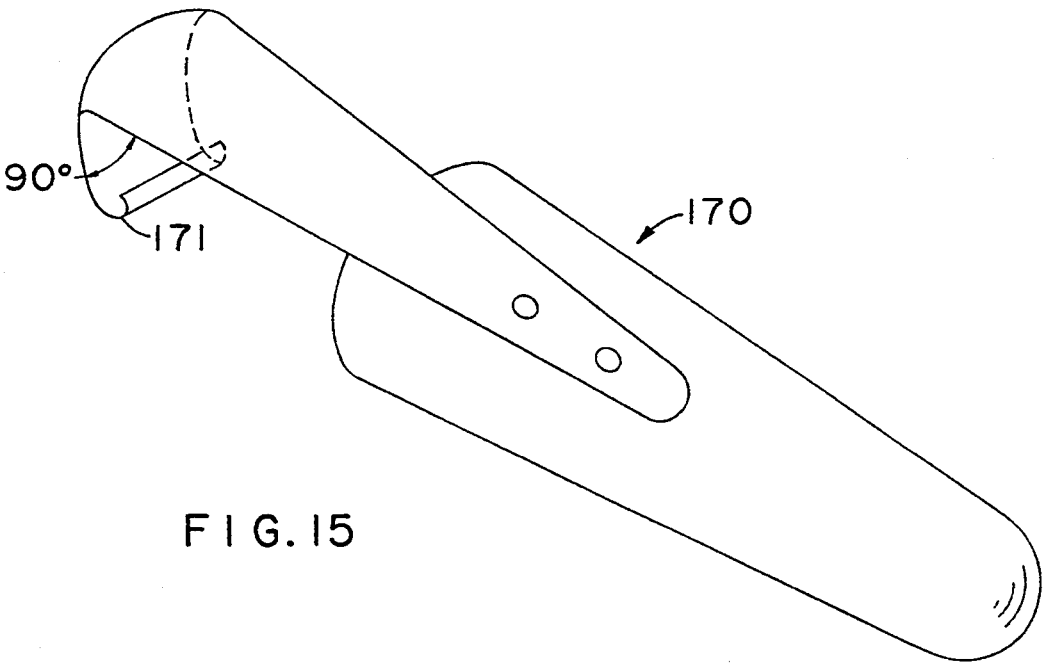
FIG. 15 is a perspective view of a tool for removing either the first alternative or second alternative removable cover strips of FIGS. 14D and 14C.

Removing alternative cover strip 141 is accomplished by using an alternative cover removal tool 170 as shown in FIG. 15, where the tool 170 is initially used to release cover strip 141 along second alternative securing means 146. Alternative curved end hook 171 of tool 170, as shown in FIG. 15, is inserted in groove 160 so that alternative curved end hook 171 can be wrapped around the edge of second side 148 of second alternative securing means 146, in a similar manner to the removal explained with respect to FIG. 12 and first securing means 113. Alternative curved end hook 171 of alternative cover removal tool 170 can be curved uniformly along its edge, or it can be of varying curvature similar to the hook 51 shown in FIG. 5.

Figure 14C:
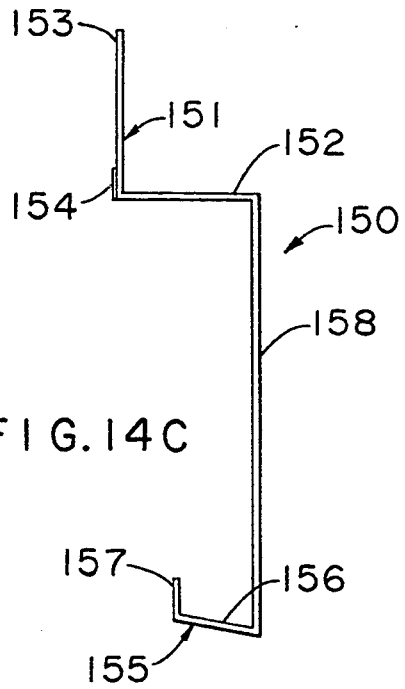
FIG. 14C is an end view of the second alternative removable cover strip shown in FIG. 14A.
Figure 14D:
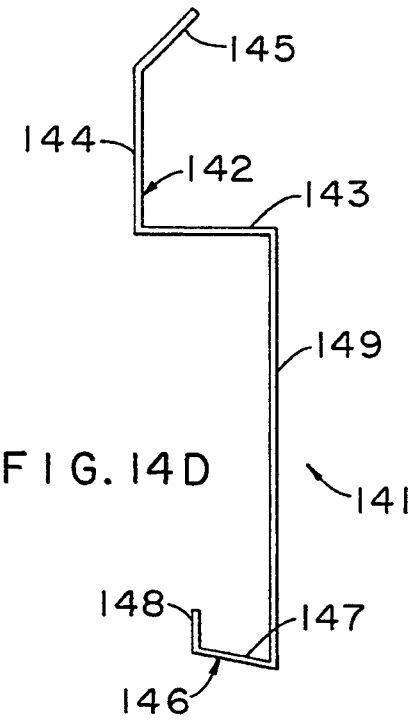
FIG. 14D is an end view of the first alternative removable cover strip shown in FIG. 14A.

Alternative removable cover strip 150 is similar to alternative removable cover strip 141, except that with strip 150 the first alternative means for securing a removable cover strip 151 does not contain a third side such as the third side 145 of first alternative securing means 142 of strip 141. First alternative securing means 151 comprises a first side 152 and a second side 153 attached to said first side 152. Attached to the back of second side 153 is tape 154 or some other adhesion means, best seen in FIG. 14C. Alternative removable cover strip 150 further comprises a second alternative means for securing a removable cover strip 155, which is very similar to second alternative securing means 146 of strip 141, shown in FIG. 14D. Second alternative securing means 155 comprises a first side 156 and a second side 157 attached to said first side 156 at an angle that comports with the corresponding sides of groove 160 on which it is secured. Alternative removable cover strip 150 further comprises a panel 158, which connects first alternative securing means 151 to second alternative securing means 155.

Alternative removable cover strip 150 is attached and removed in essentially the same way as alternative removable cover strip 141. Tape 154 or other adhesive means may have to be scraped off of groove 160 if alternative removable cover strip 150 is used and removed.

Accordingly, it is apparent from the foregoing detailed description and illustrative drawings that removable surface coverings, and tools for facilitating the use thereof, have been invented which satisfy the objectives and achieve the advantages stated throughout this specification. Other variations and modifications of this invention may be made without departing from the overall structures, methods, functions and results described and claimed herein.

What is claimed is:

1. A slat-wall cover strip for altering the aesthetic appearance of a slat-wall comprising one or more slats each of which is located between grooves adjacent thereto, wherein said slat-wall cover strip comprises:

(a) a first means for securing a removable cover strip along a first side of a groove;

(b) a second means for securing a removable cover strip; and (c) a panel connecting said first securing means to said second securing means, wherein at least a portion of said first means for securing a removable cover strip is acutely angled as compared to said panel to permit said cover strip to snap onto said slat-wall, whereby said cover strip can be replaced with other cover strips of different aesthetic appearance.

2. A slat-wall cover strip as in claim 1, wherein said first securing means further comprises a beaded edge.

3. A slat-wall cover strip as in claim 1, wherein said first securing means further comprises a flat angled portion.

4. A slat-wall cover strip as in claim 1, wherein said second securing means comprises a flat edge.

5. A slat-wall cover strip as in claim 1, wherein said first securing means further comprises an intermediate flat angled portion and an extreme curved portion.

6. A slat-wall cover strip as in claim 1, wherein said first securing means further comprises an intermediate flat angled portion and an extreme flat angled portion.

7. A slat-wall cover strip as in claim 1, wherein said second securing means comprises an intermediate flat angled portion and an extreme flat angled portion.

8. A slat-wall cover strip as in claim 1, wherein said first securing means further comprises a first intermediate flat angled portion and an extreme curved portion, and wherein said second securing means comprises a second intermediate flat angled portion and an extreme flat angled portion.

9. A slat-wall cover strip as in claim 1, wherein said first securing means further comprises a first intermediate flat angled portion and a first extreme flat angled portion, and wherein said second securing means comprises a second intermediate flat angled portion and a second extreme flat angled portion.

10. A slat-wall cover strip for altering the aesthetic appearance of a slat-wall comprising one or more slats each of which is located between grooves adjacent thereto, wherein said slat-wall cover strip comprises:

(a) a first means for securing a removable cover strip along a first side of a groove;

(b) a second means for securing a removable cover strip; and (c) a panel connecting said first securing means to said second securing means, wherein at least a portion of said first means for securing a removable cover strip is acutely angled as compared to said panel to permit said cover strip to snap onto said slat-wall, and wherein said first means for securing a removable cover strip further comprises a curved portion, whereby said cover strip can be replaced with other cover strips of different aesthetic appearance.

11. The invention of claim 10, wherein said curved portion comprises a beaded edge.

12. An elastically flexible slat-wall groove insert comprises:

(a) a first curved end;

(b) a second curved end; and (c) a panel portion connecting said first curved end to said second curved end wherein said panel portion is short enough in height to allow said insert to snap into and out of a grove in a slat-wall whereby said groove insert can be replaced with other groove inserts of different aesthetic appearance.

13. A slat-wall groove insert as in claim 12, wherein said first curved end comprises a curve of about 180 degrees and a straight portion.

14. A slat-wall groove insert as in claim 12, wherein said second curved end comprises a beaded edge.

15. A slat-wall groove insert as in claim 12, wherein said second curved end comprises a curve of about 120 degrees.

16. A slat-wall groove insert as in claim 12, wherein said second curved end comprises a curve of about 120 degrees and a beaded edge.

17. A slat-wall groove insert as in claim 12, wherein said first curved end comprises a curve of about 180 degrees, and wherein said second curved end comprises a curve of about 120 degrees and a beaded edge.

18. A slat-wall covering system comprising one or more removable cover strips as in claim 1 and one or more removable groove inserts as in claim 12.

19. A slat-wall covering system comprising a plurality of removable cover strips as in claim 1.

20. A slat-wall covering system comprising a plurality of groove inserts as in claim 12.

* * * * *